US008018154B2

(12) United States Patent
Fukui et al.

(10) Patent No.: US 8,018,154 B2
(45) Date of Patent: Sep. 13, 2011

(54) PLASMA DISPLAY PANEL AND ITS MANUFACTURING METHOD

(75) Inventors: Yusuke Fukui, Osaka (JP); Takuji Tsujita, Osaka (JP); Jun Hashimoto, Osaka (JP); Hikaru Nishitani, Nara (JP); Masaharu Terauchi, Hyogo (JP); Mikihiko Nishitani, Nara (JP)

(73) Assignee: Panasonic Corporation, Osaka (JP)

( * ) Notice: Subject to any disclaimer, the term of this patent is extended or adjusted under 35 U.S.C. 154(b) by 317 days.

(21) Appl. No.: 12/297,200

(22) PCT Filed: Apr. 27, 2007

(86) PCT No.: PCT/JP2007/059190

§ 371 (c)(1),
(2), (4) Date: Oct. 14, 2008

(87) PCT Pub. No.: WO2007/126061

PCT Pub. Date: Nov. 8, 2007

(65) Prior Publication Data

US 2009/0167176 A1 Jul. 2, 2009

(30) Foreign Application Priority Data

Apr. 28, 2006 (JP) ..... 2006-125924

(51) Int. Cl.
*H01J 17/49* (2006.01)

(52) U.S. Cl. ..... 313/582; 313/584; 313/586; 313/587; 445/24; 445/25; 345/60

(58) Field of Classification Search ..... 313/582–587; 445/24–25; 345/60
See application file for complete search history.

(56) References Cited

U.S. PATENT DOCUMENTS

| | | | | |
|---|---|---|---|---|
| 6,816,134 | B2 * | 11/2004 | Kajiyama et al. | 345/60 |
| 2003/0090206 | A1 * | 5/2003 | Uemura et al. | 313/586 |
| 2004/0145316 | A1 * | 7/2004 | Nishitani et al. | 313/587 |
| 2006/0251799 | A1 | 11/2006 | Nishitani et al. | |
| 2007/0001601 | A1 * | 1/2007 | Nishitani et al. | 313/582 |

FOREIGN PATENT DOCUMENTS

| | | |
|---|---|---|
| JP | 11-339665 | 12/1999 |
| JP | 2000-290062 | 10/2000 |
| JP | 2001-243886 | 9/2001 |
| JP | 2002-231129 | 8/2002 |
| JP | 2003-151446 | 5/2003 |
| JP | 2004-281081 | 10/2004 |
| JP | 2004-363079 | 12/2004 |
| JP | 2005-332718 | 12/2005 |
| JP | 2006-028005 | 2/2006 |
| WO | 2005/043578 | 5/2005 |

* cited by examiner

*Primary Examiner* — Nimeshkumar Patel
*Assistant Examiner* — Mary Ellen Bowman

(57) ABSTRACT

A PDP can be driven at low voltage while having a charge retention property in a protection layer, and has favorable image display properties. Additionally, the PDP prevents the occurrence of discharge delay and realizes high-quality image display by performing favorable high-speed driving in a high definition PDP. To achieve this, a surface layer (8) is formed to a film thickness of 1 μm in an oxygen atmosphere having an oxygen partial pressure of 0.025 Pa or more, the surface layer (8) is provided on a face of a dielectric layer (7) on a discharge space side. Furthermore, MgO particles (16) are dispersed on a surface of the surface layer (8). The surface layer (8) has the effects of protecting the dielectric layer (7) from ion bombardment during discharge, reducing the firing voltage, and preventing excessive electron loss. Also, the MgO particles (16) have a high initial electron emission property.

17 Claims, 8 Drawing Sheets

PLASMA DISPLAY PANEL AND ITS MANUFACTURING METHOD

TECHNICAL FIELD

The present invention relates to a plasma display panel and its manufacturing method, and in particular to technology for achieving both low-voltage driving and the prevention of excessive electron loss.

BACKGROUND ART

A plasma display panel (hereinafter, called a "PDP") is a flat display apparatus that makes use of radiation from gas discharges. PDPs can easily perform high-speed display and be large in size, and are widely used in fields such as video display apparatuses and public information display apparatuses. There are two types of PDPs, namely the direct current type (DC type) and alternating current type (AC type). Surface discharge AC type PDPs have been commercialized due to having a great amount of technological potential in terms of lifetime and increases in size. FIG. 8 is a schematic view showing the structure of a discharge cell that is a discharge unit in a general AC type PDP. A PDP 1*x* shown in FIG. 8 includes a front panel 2 and a back panel 9 that have been disposed in opposition to each other. In the front panel 2, a plurality of display electrode pairs 6, each including a scan electrode 5 and a sustain electrode 4, have been arranged on one face of a front panel glass 3, and a dielectric layer 7 and a surface layer 8 have been formed thereon in the stated order so as to cover the display electrode pairs 6. The scan electrodes 5 and sustain electrodes 4 are constituted respectively from transparent electrodes 51 and 41 and bus lines 52 and 42 formed thereon.

The dielectric layer 7 is formed from low melting point glass whose softening point is in the range of 550° C. to 600° C., and has a current limiting function that is unique to AC type PDPs.

The surface layer 8 protects the dielectric layer 7 and display electrode pairs 6 from the bombardment of ions generated by plasma discharges, as well as efficiently emits secondary electrons, thereby reducing the firing voltage. In general, the surface layer 8 is formed by using a vacuum deposition method or printing method to form a layer of magnesium oxide (MgO), which is superior in terms of secondary electron emission, sputter resistance, and transparency. There are cases in which a structure similar to the surface layer 8 is provided as a protective layer for the purpose of protecting the dielectric layer 7 and display electrode pairs 6, as well as ensuring secondary electron emission.

In the back panel 9, a plurality of data (address) electrodes 11 for writing image data have been provided on a back panel glass 10 so as to orthogonally intersect the display electrode pairs 6 on the front panel 2. A dielectric layer 12 formed from low melting point glass has been provided on the back panel glass 10 so as to cover the data electrodes 11. Ribs 13 made of low melting point glass have been formed to a predetermined height on the dielectric layer 12 at borders between adjacent discharge cells (not depicted). The ribs 13 include pattern portions 1231 and 1232 that combine to form a lattice pattern or the like, so as to demarcate discharge spaces 15. Phosphor layers 14 (phosphor layers 14R, 14G, and 14B) have been formed on the surface of the dielectric layer 12 and side walls of the ribs 13 by the application and baking of red, green, and blue phosphor inks and baking thereof.

The front panel 2 and the back panel 9 are disposed so that the display electrode pairs 6 and the data electrodes 11 intersect each other via the discharge spaces 15, after which a periphery of the front panel 2 and back panel 9 is sealed. At this time, a rare gas mixture including Xe and Ne, Xe and He, or the like is enclosed as a discharge gas at a pressure of several tens of kPa in the discharge spaces 15 sealed between the front panel 2 and back panel 9. This completes the formation of the PDP 1*x*.

In PDPs, image display is performed with the use of a gray-scale expression system (e.g., an intra-field time-division display system) that divides one image field into a plurality of sub fields (S.F.). However, in recent years there has been desire for low-power driving in electrical appliances, and the same desire exists for PDPs as well. Since discharge cells are made smaller and increased in number in high definition PDPs, there is the problem of requiring a higher operating voltage in order to increase the reliability of writing discharges. The operating voltage of a PDP depends on the secondary electron emission coefficient (γ) of the surface layer. Here, the value of γ depends on the material of the surface layer and the discharge gas, and γ is known to increase as the work function of the material decreases. In view of this, patent document 4 discloses the use of calcium oxide (CaO), strontium oxide (SrO), barium oxide (BaO) or the like as the main component of the protective layer. Doing so enables the formation of a high γ film that has a more favorable secondary electron emission property than MgO, and enables the PDP to be driven at a relatively low voltage.

Patent document 1: Japanese Patent Application Publication No. H08-236028

Patent document 2: Japanese Patent Application Publication No. H10-334809

Patent document 3: Japanese Patent Application Publication No. 2006-54158

Patent document 4: Japanese Patent Application Publication No. 2002-231129

Patent document 5: WO 2005/043578

DISCLOSURE OF THE INVENTION

Problems Solved by the Invention

However, although the use of calcium oxide (CaO), strontium oxide (SrO), barium oxide (BaO) etc. in the protective layer enables driving a PDP at a low voltage, there is "excessive charge loss" in the protective layer. "Excessive charge loss" is a phenomenon in which an excessive amount of electrons are emitted from the protective layer during driving of the PDP. Compared to MgO, CaO, SrO, and BaO generally have a higher rate of impurity adsorption, and when impurities are adsorbed, oxygen loss occurs in the band structure of the protective layer, and unnecessary energy levels are formed in the vicinity of the vacuum level. It is these shallow energy levels that trigger the problem of excessive charge loss. When excessive charge loss occurs during PDP driving, a sufficient charge for sustain discharges cannot be retained during the sustain period of a subfield, thereby leading to a discharge failure. Note that although one method of solving the problem of excessive charge loss is supplying a new charge from an external source in order to retain a sufficient charge for discharge, this causes an increase in the driving voltage, thereby eliminating the advantage of using CaO, SrO, or BaO.

Also, the problem of "discharge delay" occurs in PDPs. Specifically, the definition of video sources has been increasing in the field of displays such as PDPs, and the number of scan electrodes (scan lines) required to properly display high definition images is rising. For example, the number of scan lines in full high-definition TV is at least two times greater than NTSC format TV. Since one field must be displayed in 1/60 [s] or less, the display of high definition video on a PDP requires narrowing the width of pulses applied to the data electrodes in the write periods of sub fields. However, during PDP driving, a time lag called a "discharge delay" occurs between a rising edge in a voltage pulse and an actual discharge in a discharge cell. As the pulse width is made narrower for high speed driving, the influence of "discharge delay" increases, and there is a decrease in the probability of a discharge ending during a period equal to the pulse width. As a result, some cells are not lit (a lighting failure), and image display performance is compromised. Note that there is technology in which a protective layer including MgO as a main component is modified by adding Fe,Cr or Si,Al to the MgO crystals in order to achieve high-speed driving by facilitating the emission of trigger electrons for write discharges and sustain discharges (patent documents 1 and 2). However, a similar method cannot easily be said to be effective in the case of CaO, SrO, and BaO.

There are several incompatible problems in the current situation of PDPs, and these problems have yet to be solved.

Means to Solve the Problems

The present invention has been achieved in view of the above problems, and aims to provide the following.

A first aim of the present invention is to provide a plasma display panel which includes a protective layer that has an improved structure, as a result of which the plasma display panel can be driven at a low voltage while having a charge retention property in the protective layer, and has favorable image display performance.

A second aim of the present invention is to provide a plasma display panel that in addition to being able to be driven at a low voltage and having a charge retention property, prevents the occurrence of discharge delay, and can perform high-quality image display by favorable high-speed driving in the case of a high definition PDP.

In order to achieve the above aims, one aspect of the present invention is a plasma display panel having a first substrate and a second substrate that oppose each other with a discharge space therebetween and are sealed together, a display electrode being provided on the first substrate, and the discharge space being filled with a discharge gas, wherein a surface layer has been provided on a face of the first substrate that faces the discharge space, a main component of the surface layer being one or more oxide selected from the group consisting of calcium oxide, barium oxide, and strontium oxide, and the surface layer has been formed in an oxygen atmosphere in which an oxygen partial pressure is 0.025 Pa or more.

Here, the surface layer may be a solid solution including one or more oxide selected from the group consisting of calcium oxide, barium oxide, and strontium oxide.

Another aspect of the present invention is a plasma display panel having a first substrate and a second substrate that oppose each other with a discharge space therebetween and are sealed together, a display electrode being provided on the first substrate, and the discharge space being filled with a discharge gas, wherein a surface layer has been provided on a face of the first substrate that faces the discharge space, a main component of the surface layer is one or more oxide selected from the group consisting of calcium oxide, barium oxide, and strontium oxide, and in the surface layer, an electron level exists only at a depth of 2 eV or more from a vacuum level.

Here, the surface layer may have been formed in an oxygen atmosphere in which an oxygen partial pressure is 0.025 Pa or more.

Another aspect of the present invention is a plasma display panel having a first substrate and a second substrate that oppose each other with a discharge space therebetween and are sealed together, a display electrode being provided on the first substrate, and the discharge space being filled with a discharge gas, wherein a surface layer has been provided on a face of the first substrate that faces the discharge space, a main component of the surface layer is one or more oxide selected from the group consisting of calcium oxide, barium oxide, and strontium oxide, and in the surface layer, an electron level at a depth of less than 2 eV from a vacuum level has been eliminated.

Another aspect of the present invention is a plasma display panel having a first substrate and a second substrate that oppose each other with a discharge space therebetween and are sealed together, a display electrode being provided on the first substrate, and the discharge space being filled with a discharge gas, wherein a surface layer has been provided on a face of the first substrate that faces the discharge space, a main component of the surface layer being one or more oxide selected from the group consisting of calcium oxide, barium oxide, and strontium oxide, and the surface layer has a photoelectron emitting property of beginning to emit photoelectrons when a gradually increased intensity of light energy irradiated on a surface of the surface layer reaches an energy of 2 eV or more.

Another aspect of the present invention is a plasma display panel having a first substrate and a second substrate that oppose each other with a discharge space therebetween and are sealed together, a display electrode being provided on the first substrate, and the discharge space being filled with a discharge gas, wherein a surface layer has been provided on a face of the first substrate that faces the discharge space, a main component of the surface layer being one or more oxide selected from the group consisting of calcium oxide, barium oxide, and strontium oxide, magnesium oxide particles have been provided on a surface of the surface layer that faces the discharge space, and the surface layer has been formed in an oxygen atmosphere in which an oxygen partial pressure is 0.025 Pa or more.

Here, the magnesium oxide particles may have been formed by a gas-phase oxidation method. Alternatively, the magnesium oxide particles may have been formed by baking a magnesium oxide precursor at a temperature of 700 degrees or more.

Another aspect of the present invention is a plasma display panel having a first substrate and a second substrate that oppose each other with a discharge space therebetween and are sealed together, a display electrode being provided on the first substrate, and the discharge space being filled with a discharge gas, wherein a surface layer has been provided on a face of the first substrate that faces the discharge space, a main component of the surface layer being one or more oxide selected from the group consisting of calcium oxide, barium oxide, and strontium oxide, magnesium oxide particles have been provided on a surface of the surface layer that faces the discharge space, and in the surface layer, an electron level exists only at a depth of 2 eV or more from a vacuum level.

Another aspect of the present invention is a plasma display panel having a first substrate and a second substrate that oppose each other with a discharge space therebetween and are sealed together, a display electrode being provided on the first substrate, and the discharge space being filled with a discharge gas, wherein a surface layer has been provided on a face of the first substrate that faces the discharge space, a main component of the surface layer being one or more oxide selected from the group consisting of calcium oxide, barium oxide, and strontium oxide, magnesium oxide particles have been provided on a surface of the surface layer that faces the discharge space, and in the surface layer, an electron level at a depth of less than 2 eV from a vacuum level has been eliminated.

Another aspect of the present invention is a plasma display panel having a first substrate and a second substrate that oppose each other with a discharge space therebetween and are sealed together, a display electrode being provided on the first substrate, and the discharge space being filled with a discharge gas, wherein a surface layer has been provided on a face of the first substrate that faces the discharge space, a main component of the surface layer being one or more oxide selected from the group consisting of calcium oxide, barium oxide, and strontium oxide, magnesium oxide particles have been provided on a surface of the surface layer that faces the discharge space, and the surface layer has a photoelectron emitting property of beginning to emit photoelectrons when a gradually increased intensity of light energy irradiated on a surface of the surface layer reaches an energy of 2 eV or more.

Another aspect of the present invention is a manufacturing method for a plasma display panel, including the steps of: forming a surface layer on a first substrate on which a display electrode is provided, a main component of the surface layer being one or more oxide selected from the group consisting of calcium oxide, barium oxide, and strontium oxide, and the surface layer being formed in an oxygen atmosphere in which an oxygen partial pressure is 0.025 Pa or more; and sealing together the first substrate and a second substrate that have been arranged with a discharge space therebetween so that the surface layer faces the discharge space.

Here, in the surface layer forming step, the surface layer may be formed by one or more of a vapor deposition method, a sputtering method, and an ion-plating method. Alternatively, in the surface layer forming step, the surface layer may be formed as a solid solution including one or more oxide selected from the group consisting of calcium oxide, barium oxide, and strontium oxide.

Another aspect of the present invention is a manufacturing method for a plasma display panel, including the steps of: forming a surface layer on a first substrate on which a display electrode is provided, a main component of the surface layer being one or more oxide selected from the group consisting of calcium oxide, barium oxide, and strontium oxide, and the surface layer being formed in an oxygen atmosphere in which an oxygen partial pressure is 0.025 Pa or more; providing magnesium oxide particles on the surface layer; and sealing together the first substrate and a second substrate that have been arranged with a discharge space therebetween so that the surface layer faces the discharge space.

Here, the magnesium oxide particles used in the providing step may have been formed by a gas-phase oxidation method. Alternatively, the magnesium oxide particles used in the providing step may have been formed by baking a magnesium oxide precursor at a temperature of 700 degrees or more.

Effects of the Invention

According to the above structure of the surface layer, the PDP is driven at a low voltage while having an improved electron retention property in the protective layer.

In addition to the above effects, providing the MgO particles on the surface layer realizes high-speed driving by suppressing the occurrence of discharge delay.

Here, the combination of the surface layer and MgO particles in the present invention corresponds to a protective layer generally provided in a PDP to protect a dielectric layer.

DESCRIPTION OF THE CHARACTERS

| | |
|---|---|
| 1, 1x | PDP |
| 2 | front panel |
| 3 | front panel glass |
| 4 | sustain electrode |
| 5 | scan electrode |
| 6 | display electrode pair |
| 7, 12 | dielectric layer |
| 8, 8a | surface layer (high γ film) |
| 9 | back panel |
| 10 | back panel glass |
| 11 | data (address) electrode |
| 13 | rib |
| 14, 14R, 14G, 14B | phosphor layer |
| 15 | discharge space |
| 16 | MgO particles |

BEST MODE FOR CARRYING OUT THE INVENTION

Although the following describes embodiments of the present invention and working examples, the present invention is of course not limited to the following embodiments and working examples. Appropriate changes may be made as long as they do not depart from the technological scope of the present invention.

Embodiment 1

Exemplary PDP Structure

Figure 1:
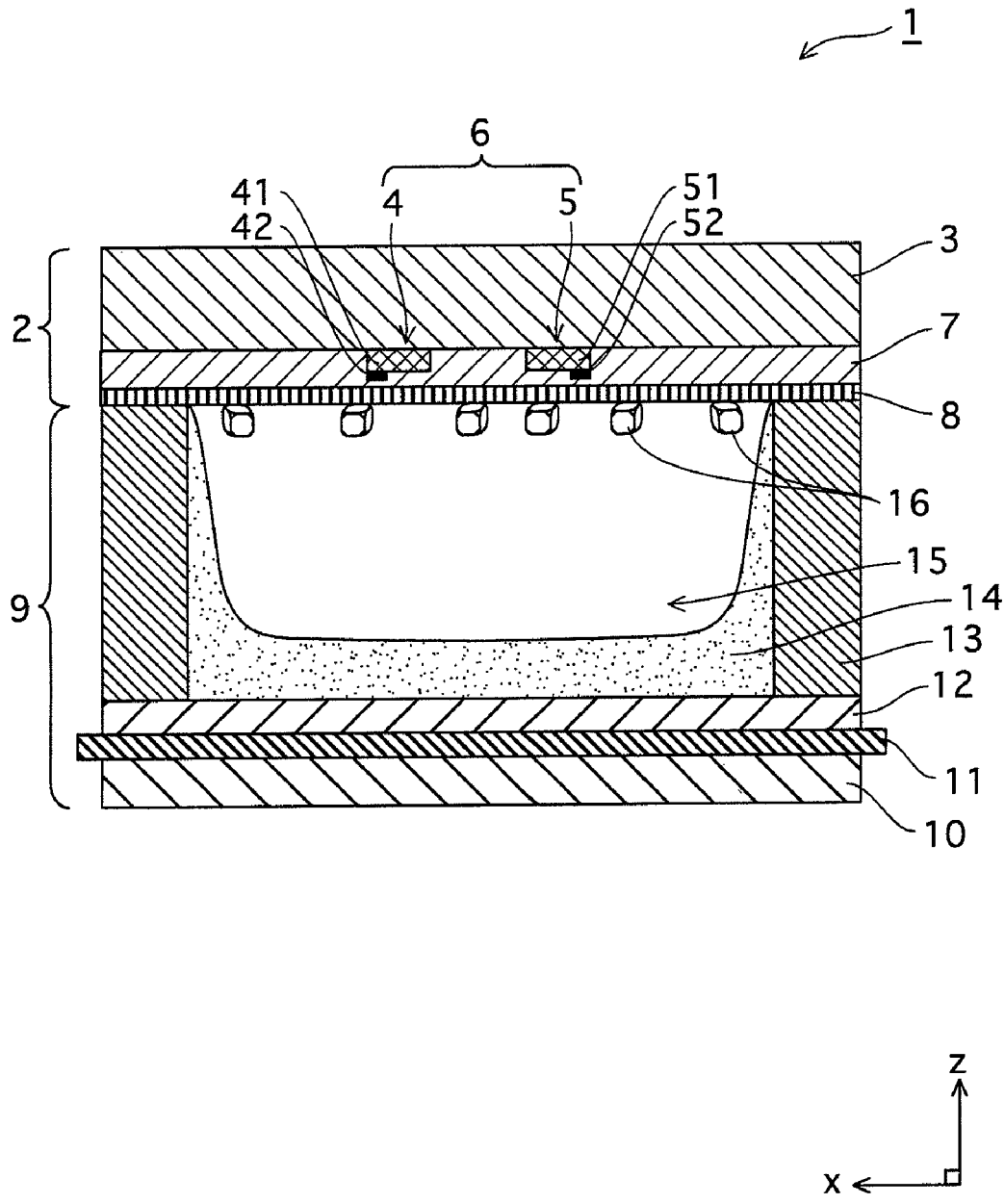
FIG. 1 is a cross-sectional view showing a structure of a PDP pertaining to embodiment 1 of the present invention.
Figure 8:
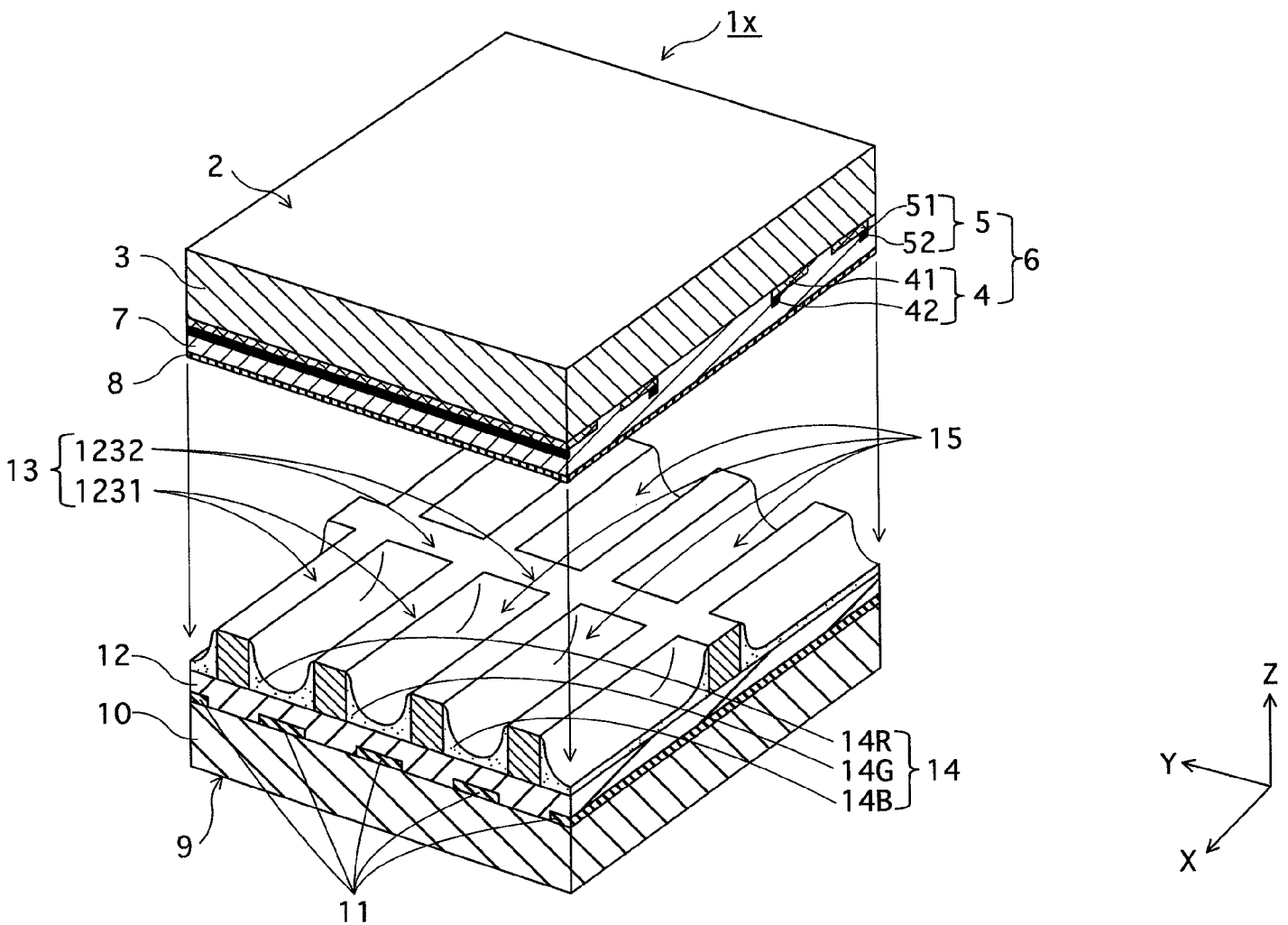
FIG. 8 shows a structure of a general PDP in conventional technology.

FIG. 1 diagrammatically shows a cross-section of a PDP 1 pertaining to embodiment 1 of the present invention, where the cross-section is taken along an x-z plane. With the exception of the structure in a vicinity of a protective layer, the PDP 1 has a structure that is basically the same as a conventional structure (FIG. 8).

Although the PDP 1 described here is a 42-inch class AC type PDP in conformity with NTSC specifications, the present invention is of course applicable to other specifications such as XGA and SXGA. The following are exemplary standards for high definition PDPs that have HD (High Definition) or higher resolutions. For 37-inch, 42-inch, and 50-inch panel sizes, the resolutions can be set at 1024×720 (pixels), 1024×768 (pixels), and 1366×768 (pixels) respectively. Alternatively, the PDP can include a panel that has a higher resolution than the above HD panels. For example, the PDP can include a full-HD panel that has a resolution of 1920×1080 (pixels).

As shown in FIG. 1, the structure of the PDP 1 can be basically divided into a front panel 2 and a back panel 9 that have been disposed so that the main faces thereof oppose each other.

The front panel 2 includes a front panel glass 3 as a substrate, and a plurality of display electrode pairs 6 (each including a scan electrode 5 and a sustain electrode 4) have been formed on the main face of the front panel glass 3 with a predetermined discharge gap (75 μm) between adjacent display electrode pairs 6. Each display electrode pair 6 includes strip-shaped transparent electrodes 51 and 41 (0.1 μm thick and 150 μm wide) on which bus lines 52 and 42 (7 μm thick and 95 μm wide) respectively have been formed. The transparent electrodes 51 and 41 are made of a transparent conductive material such as indium tin oxide (ITO), zinc oxide (ZnO), or tin oxide ($SnO_2$), and the bus lines 52 and 42 are made of an Ag thick film (2 μm to 10 μm thick), an Al thin film (0.1 μm to 1 μm thick), a Cr/Cu/Cr layered thin film (0.1 μm to 1 μm thick), or the like. The bus lines 52 and 42 lower the sheet resistance of the transparent electrodes 51 and 41.

Here, "thick film" refers to a film that has been formed by any of various thick film methods such as applying a paste including a conductive material etc. and baking the applied paste. Also, "thin film" refers to a film formed by any of various thin film methods that employ a vacuum process, such as a sputtering method, an ion plating method, and an electron-beam deposition method.

A dielectric layer 7 has been formed on the entire main face of the front panel glass 3 over the display electrode pairs 6 by a screen printing method or the like. The dielectric layer 7 is made of low melting point glass (35 μm thick) whose main component is lead oxide (PbO), bismuth oxide ($Bi_2O_3$), or phosphorous oxide ($PO_4$).

The dielectric layer 7 acts as a current limiter, which is unique to AC type PDPs, and is one factor in the realization of a longer lifetime than DC type PDPs.

A surface layer 8 having a film thickness of approximately 1 μm has been formed on the face of the dielectric layer 7 that is on the discharge space side, and MgO particles 16 have been dispersed on the surface of the surface layer 8. The combination of the surface layer 8 and the MgO particles constitutes a protective layer that protects the dielectric layer 7.

The surface layer 8 is provided with the aim of protecting the dielectric layer 7 from ion bombardment during discharges and lowering the firing voltage, and is made of a material that is superior in terms of sputter resistance and secondary electron emission coefficient γ. The material referred to here also has favorable optical transparency and electrical insulation properties. The MgO particles 16 have been provided in order to realize an excellent initial electron emission property.

In the protective layer, the surface layer 8 and the MgO particles 16 exhibit their separate properties synergistically. Also, impurities from the discharge space 15 cannot attach to the surface of the surface layer 8 in the area covered by the MgO particles 16, thereby improving the lifetime of the PDP 1. Details of the surface layer 8 and the MgO particles 16 are described later. Note that in FIG. 1, the MgO particles 16 provided on the surface of the surface layer 8 are shown diagrammatically and larger than their actual size.

The back panel 9 includes a back panel glass 10 as a substrate, on which data electrodes 11 that are 100 μm wide have been provided in a striped pattern in the y direction, where the x direction is the lengthwise direction. That is to say, the data electrodes have been provided in parallel at a predetermined interval (360 μm). The data electrodes 11 are made of any of an Ag thick film (2 μm to 10 μm thick), an Al thin film (0.1 μm to 1 μm thick), a Cr/Cu/Cr layered thin film (0.1 μm to 1 μm thick), or the like. Also, a dielectric layer 12 having a thickness of 30 μm has been provided on the entire main face of the back panel glass 9 so as to entirely cover each of the data electrodes 11.

Ribs 13 (approximately 110 μm high and 40 μm wide) have been provided on the dielectric layer 12 in a lattice pattern that conforms to the gaps between adjacent data electrodes 11. The ribs 13 demarcate the discharge cells, thereby preventing erroneous discharges and optical crosstalk.

Phosphor layers 14 corresponding to the colors red (R), green (G), and blue (B) for color display have been formed on the lateral faces of pairs of adjacent ribs 13 and on the face of the dielectric layer 12 therebetween. Note that the provision of the dielectric layer 12 is not required. The phosphor layers 14 may be formed directly on the data electrodes 11.

The front panel 2 and back panel 9 are disposed in opposition so that the lengthwise directions of the data electrodes 11 and the display electrode pairs 6 are orthogonal to each other, and the outer periphery of the panels 2 and 9 is sealed with glass frit. A discharge gas made of inactive gas components such as He, Xe, and Ne is enclosed between the panels 2 and 9 at a predetermined pressure.

The discharge spaces 15 exist between the ribs 13, and discharge cells (also called "subpixels") for image display correspond to areas where a data electrode 11 crosses a pair of adjacent display electrode pairs 6 via a discharge space 15. The pitch of each discharge cell is 675 μm in the x direction and 300 μm in the y direction. Three adjacent discharge cells corresponding to the colors R, G, and B constitute a single pixel (675 μm×900 μm).

Figure 2:
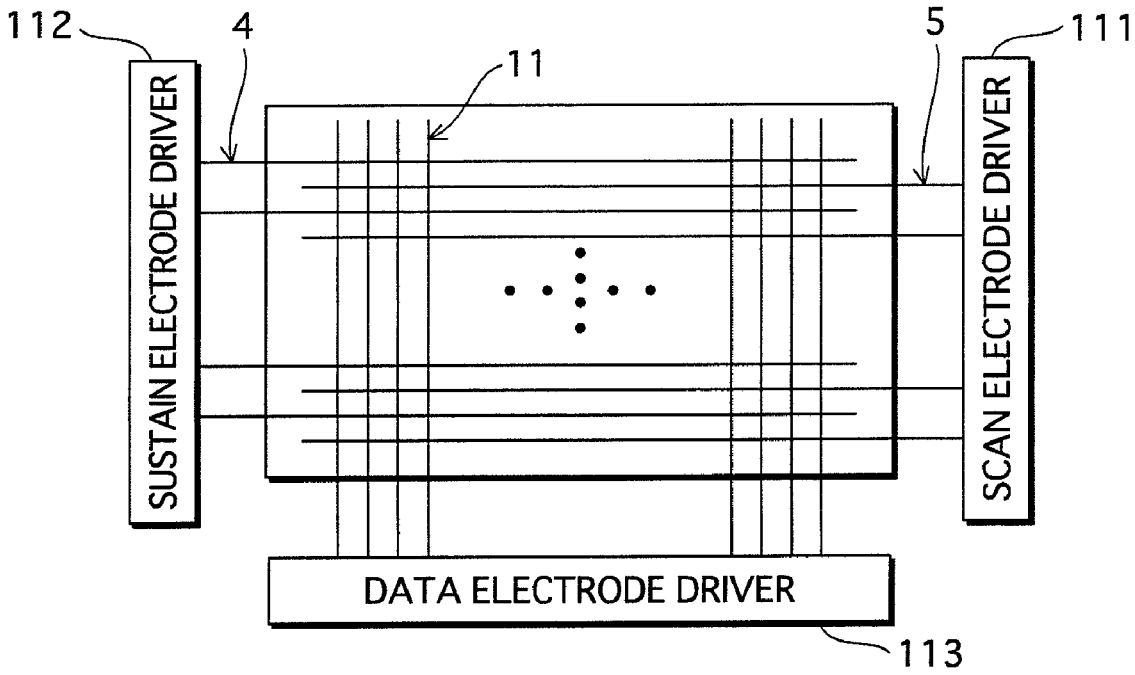
FIG. 2 diagrammatically shows relationships between electrodes and drivers.

As shown in FIG. 2, the scan electrodes 5, sustain electrodes 4, and data electrodes 11 are connected to a scan electrode driver 111, a sustain electrode driver 112, and a data electrode driver 113 respectively, which are drive circuits.

Exemplary PDP Driving

During driving of the PDP 1 having the above structure, a known drive circuit (not depicted) that includes the drivers 111 to 113 is used to apply an AC voltage of tens of kHz to hundreds of kHz to the gaps between the display electrode pairs 6. Accordingly, a discharge occurs in an arbitrary discharge cell, the phosphor layers 14 are irradiated by ultraviolet radiation (dashed line and arrows in FIG. 1) that includes mainly 147-nm resonance lines generated by excited Xe atoms and mainly 173-nm molecular beams generated by excited Xe molecules. The phosphor layers 14 become excited and emit visible light. Such visible light passes through the front panel 2 and is emitted in a forward direction.

One example of such a driving method is an intrafield time-division gradation display method. In this method, a field to be displayed is divided into a plurality of subfields (S.F.), and each subfield is further divided into a plurality of periods. Each subfield includes the four periods of (1) an initialization period for initializing all discharge cells, (2) and address (write) period for addressing discharge cells and selecting and inputting display states corresponding to input data to the discharge cells, (3) a sustain period for causing the discharge cells in the display state to emit light for display, and (4) an erase period for erasing wall charges formed as a result of the sustain discharges.

In the subfields, all wall charges are reset by an initialization pulse in the initialization period, then write discharges are generated in the write period to cause the accumulation of wall charges in discharge cells that are to be lit, and thereafter an alternating voltage (sustain voltage) is applied to all of the discharge cells at once in the discharge sustain period in order to sustain discharges for a certain period. As a result, light is emitted and display is performed.

Figure 3:
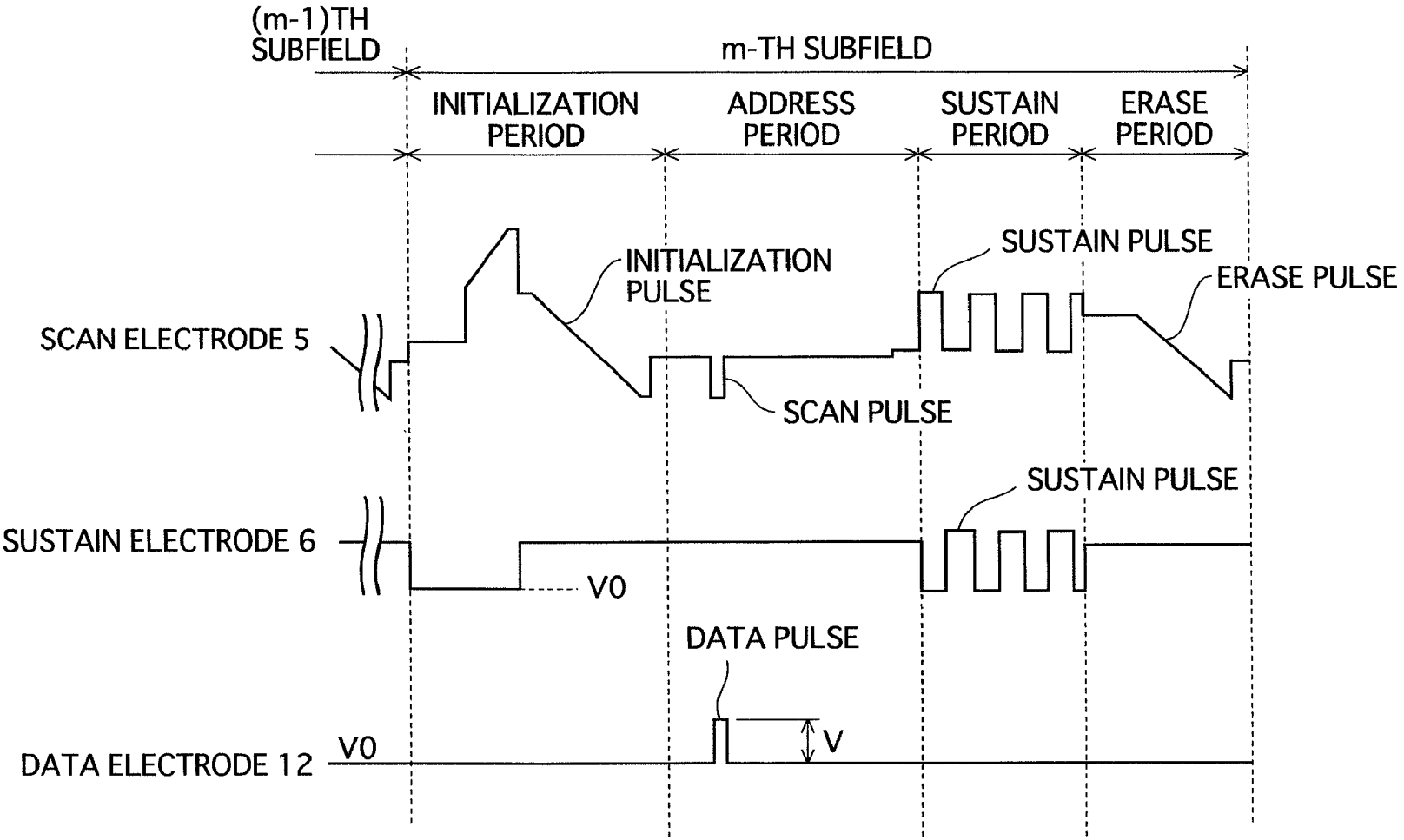
FIG. 3 shows an exemplary PDP drive waveform.

FIG. 3 shows exemplary drive waveforms in an m-th subfield of a field. As shown in FIG. 3, each subfield includes an initialization period, a write period, a discharge sustain period, and an erase period.

The initialization period is a period in which all wall charges are erased (using an initialization discharge) in order to prevent a previous lighting of a discharge cell from having any influence (influence due to the accumulated wall charge). In the exemplary drive waveforms shown in FIG. 3, a higher voltage (initialization pulse) is applied to the scan electrode 5 than the data electrode 11 and sustain electrode 4, to cause a discharge of the gas in the discharge cell. The charge generated by this discharge is accumulated on the walls of the discharge cells so as to negate the difference in potential between the data electrode 11, scan electrode 5, and sustain electrode 4. As a result, a negative charge is formed as a wall charge on the surface of the MgO particles 16 and the surface layer 8 in the vicinity of the scan electrode 5. Also, a positive charge is formed as a wall charge on the surface of the phosphor layer 14 in the vicinity of the data electrode 11 and on the surface of the MgO particles 16 and the surface layer 8 in the vicinity of the sustain electrode 4. These wall charges generate a wall potential having a predetermined value between the scan electrode 5 and the data electrode 11, and between the scan electrode 5 and the sustain electrode 4.

The write period is a period in which addressing (lit or unlit configuration) is performed on discharge cells selected based on the image signal assigned to the subfield. In this period, in a case of causing a discharge cell to be lit, a lower voltage (scan pulse) is applied to the scan electrode 5 than the data electrode 11 and sustain electrode 4. In other words, a write discharge is generated by applying a voltage between the scan electrode 5 and data electrode 11 in the same direction as the wall potential, while applying a data pulse between the scan electrode 5 and sustain electrode 4 in the same direction as the wall potential. Therefore, a negative charge is formed on the surface of the phosphor layer 14 and on the surface of the MgO particles 16 and the surface layer 8 in the vicinity of the sustain electrode 4, and a positive charge is formed on the surface of the MgO particles 16 and the surface layer 8 in the vicinity of the scan electrode 5. As a result, a wall potential having a predetermined value is generated between the sustain electrode 4 and scan electrode 5.

The discharge sustain period is a period in which the lighting state configured by the write discharge is amplified and the discharge is sustained in order to ensure a brightness in accordance with the desired gradation. In discharge cells where wall charges have been formed, voltage pulses (e.g., approximately 200 V rectangular waveform voltages) having mutually different phases are applied to each pair of a scan electrode 5 and a sustain electrode 4 in order to sustain discharges. As a result, each time there is a change in voltage polarity, pulse discharges are generated in discharge cells in which a display state has been written.

The sustain discharge causes the emission of 147-nm resonance lines from excited Xe atoms in the discharge space and mainly 173-nm molecular beams from excited Xe molecules. The resonance lines and molecular beams irradiate the surface of the phosphor layer 14, and are converted by the phosphor layer 14 into visible light for display. Multiple colors and multiple gradations are achieved by combinations of R, G, and B subfields. Note that a sustain discharge is not generated in non-discharging cells, in which a wall charge has not been written on the surface layer 8, and such non-discharging cells have a display state of "black display".

In the erase period, a gradually decreasing erase pulse is applied to the scan electrode 5, thereby erasing the wall charge.

Surface Layer 8

The surface layer 8 includes one or more of CaO, SrO, and BaO as a main component, and is formed as a film using a sputtering method, an ion plating method, a vapor deposition method or the like, in an atmosphere in which the partial pressure of oxygen is 0.025 Pa or more. The surface layer 8 lowers the firing voltage and has an effect of preventing excessive electron loss.

Lowering of Firing Voltage

The surface layer 8 includes one or more of CaO, SrO, and BaO as a main component. In the surface layer 8, the energy level that is unique to CaO, SrO, and BaO exists in an area whose depth from the vacuum level is shallower than an energy level that is unique to MgO. Accordingly, during driving of the PDP 1, electrons in the energy level unique to CaO, SrO, and BaO move to an energy level corresponding to the Xe ion ground state. Here, the amount of energy captured by other electrons in the energy level unique to CaO, SrO, and BaO due to the Auger effect is higher than a case in which the surface layer 8 is formed from MgO. This amount of energy is sufficient to allow these other electrons to exceed the vacuum level and be emitted. As a result, in the surface layer 8, such materials exhibit a more favorable secondary electron emission property than MgO.

Specifically, the energy level unique to CaO, SrO, and BaO exists in an area whose depth from the vacuum level is 6.05 eV or less, and the energy level unique to MgO exists in an area whose depth from the vacuum level is more than 6.05 eV.

The following describes grounds for the areas where the unique electron levels exist, with use of a description of the movement of electrons between states during exchanges of energy between the surface layer 8 and the gas enclosed in the discharge spaces.

First, when ions originating from discharge gas and produced in the discharge space come close enough to the surface of the surface layer 8 to allow interaction, the electrons in the energy level unique to the material constituting the surface layer 8 move to an energy level corresponding to the ground state of the discharge gas ions. As a result, due to the Auger effect, other electrons in the energy level unique to the material constituting the surface layer 8 receive an amount of energy equal to the depth of the ground state level of the discharge gas ions minus the depth of the electron level unique to the material constituting the surface layer 8, jump the energy gap to the vacuum level, and are emitted as secondary electrons (see patent document 5 for details).

Figure 4:
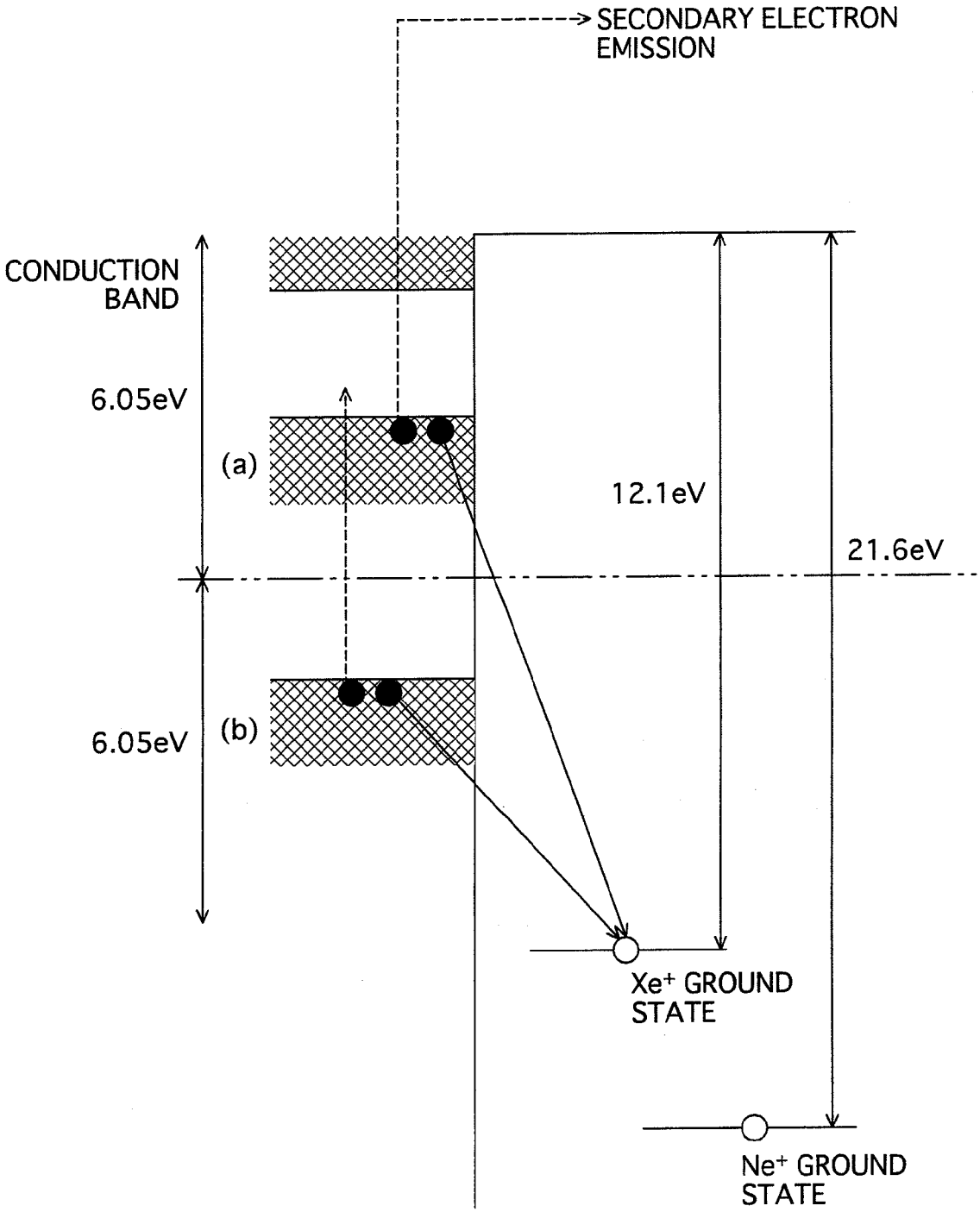
FIG. 4 illustrates energy levels in a surface layer of the PDP of embodiment 1 and a protective layer of a conventional PDP.

In the band structure shown in FIG. 4, the Xe ions are in a ground state energy level that is 12.1 eV deep from the vacuum level. Therefore, if the electron level unique to the material constituting the surface layer 8 exists in an area whose depth is less than 6.05 eV, which is half of 12.1 eV ((a) in FIG. 4), the electrons in this electron level receive an amount of energy (6.05 eV or more) that is equal to the depth of the ionization level (12.1 eV) minus the depth of the electron level unique to the material constituting the surface layer 8. As a result, these electrons jump the energy gap to the vacuum level and can be emitted. On the other hand, when the energy level unique to the material constituting the surface layer exists at a depth of greater than 6.05 eV, which is half of 12.1 eV ((b) in FIG. 4), even if electrons in this electron level receive an amount of energy (less than 6.05 eV) that is equal to the depth of the ionization level (12.1 eV) minus the depth of the electron level unique to the material constituting the surface layer 8, these electrons cannot jump the energy gap to the vacuum level and be emitted.

In another experiment, the inventors of the present invention confirmed that when Xe is used as the discharge gas, the firing voltage is higher in a case where the main component of the protective layer is MgO than a case of using the surface layer 8 of the present embodiment that includes CaO, BaO, and/or SrO as a main component. This trend became pronounced in proportion to the partial pressure of Xe in the discharge gas.

Based on the above, in the surface layer 8, the energy level unique to CaO, SrO, and BaO is considered to exist in an area at a depth of 6.05 eV or less, and the energy level unique to MgO is considered to exist in an area that over 6.05 eV deep from the vacuum level.

Note that in general, the sum of the electron affinity and the material-unique band gap is approximately 8.8 eV for MgO, approximately 8.0 eV for CaO, approximately 6.9 eV for SrO, and approximately 5.2 eV for BaO. The above are observed values in a bulk portion of the surface layer 8. In the present invention, the sum of the band gap and electron affinity of MgO is considered to be greater than 6.05 eV, and the sums of the band gaps and electron affinities of CaO, BaO, and SrO are each considered to be 6.05 eV or less. Therefore, compared to the above values, a reduction of 2 eV was seen. This is because the sum of the band gap and electron affinity in the present embodiment is an observed value in the surface portion of the surface layer 8 that actually influences discharges. The fact that the band gap in the vicinity of the surface of the surface layer 8 is smaller than the band gap in the bulk of the surface layer 8 is though to be due to the fact that, unlike in the interior, the bonds between atoms in the surface portion are broken.

Note that "surface portion" refers to a portion from the outermost surface of the surface layer 8 to a depth of tens of atoms.

Prevention of Excessive Charge Loss

Due to including one or more of CaO, SrO, and BaO and being formed as a film in an atmosphere in which the partial pressure of oxygen is 0.025 Pa or more, the surface layer 8 has a crystal structure that includes few impurities and few oxygen defects. As a result, unnecessary energy levels in the vicinity of the vacuum level are eliminated, and only an electron level that is at least 2 eV deep from the vacuum level remains. In other words, in the surface layer 8 of the present embodiment, energy levels less than 2 eV deep from the vacuum level have been eliminated. This structure suppresses the excessive mission of electrons from unnecessary energy levels in the vicinity of the vacuum level during PDP driving, thereby achieving both low-voltage driving and a favorable secondary electron emission property, as well as an adequate electron retention property. The charge retention property particularly enables retaining the charge generated during the initialization period and is effective in performing reliable write discharges by preventing write failures in the write period.

Specifically, an unnecessary energy level in the vicinity of the vacuum level is an energy level that is less than 2 eV deep from the vacuum level in the energy band.

The following describes grounds for the above, with use of results of measuring cathodoluminescence in a protective layer made of an alkali earth metal oxide.

Figure 5:
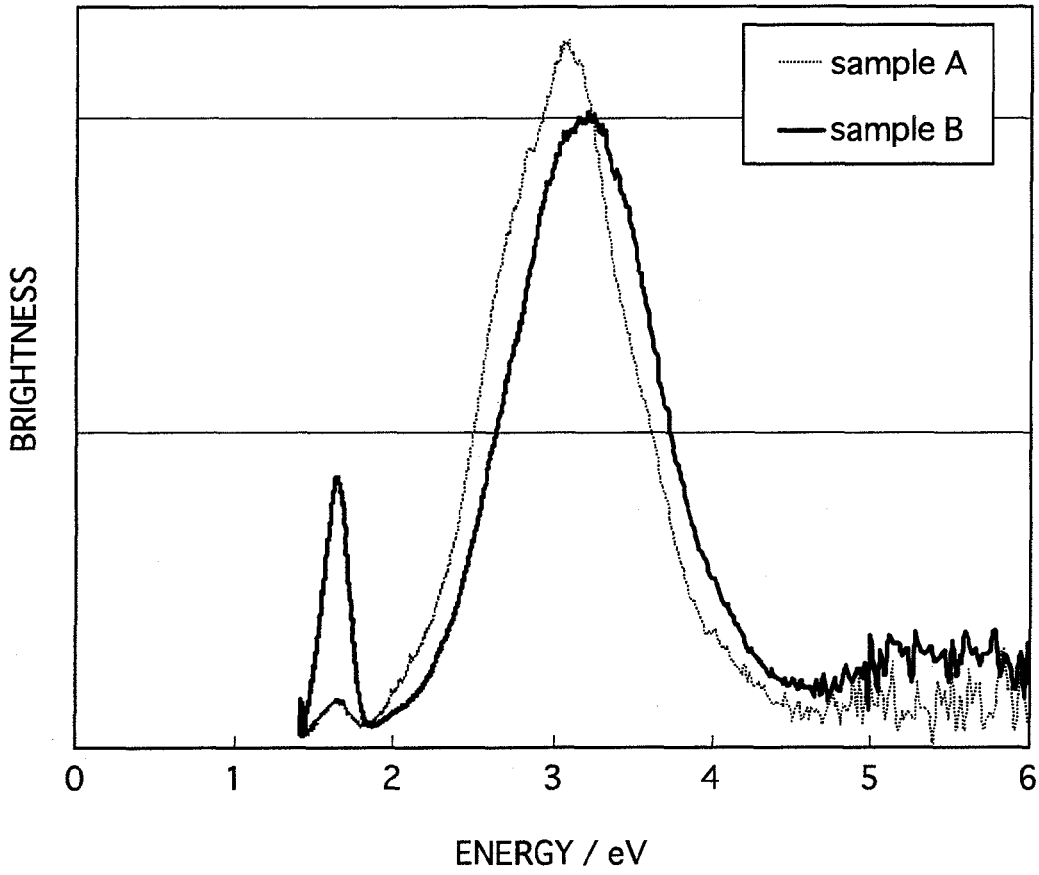
FIG. 5 shows properties of protective layers composed of alkali earth metal oxides in a measurement of cathode luminescence.

FIG. 5 shows results of measuring the cathodoluminescence of protective layers (sample A and sample B) made of an alkali earth metal oxide. The irradiating electron beams have an energy of 3 kV and the measured wavelength region was 200 to 900 nm. The values indicated by the horizontal axis are detected wavelengths converted to energy values. Both samples A and B have a strong emitted light spectrum in the vicinity of 3 eV. Sample A has almost no emitted light spectrum in the vicinity of 1 to 2 eV, whereas sample B has a strong emitted light spectrum in the vicinity of 1 to 2 eV.

In another experiment, the inventors of the present invention confirmed that a PDP using the protective layer of sample A does not have cells that fail to light due to excessive charge loss at a normal driving voltage, and excessive charge loss does not readily occur. The inventors of the present invention also confirmed that a PDP using the protective layer of sample B has cells that fail to light due to excessive charge loss at a normal driving voltage, and excessive charge loss readily occurs. Based on the above, it can be considered that electrons which are excessively emitted during PDP driving are electrons occupying an energy level less than 2 eV deep from the vacuum level.

Confirmation Method

The elimination of energy levels less than 2 eV deep from the vacuum level in the energy band in the surface layer 8 of the present embodiment can be confirmed by results obtained by irradiating the surface layer 8 that includes CaO, BaO, and/or SrO as a main component and measuring the amount of electrons emitted from the surface layer 8. This is because the electrons in the electron levels capture an amount of energy equal to the energy of the irradiated light, and electron emission (photoelectron emission) only begins when enough energy has been captured to jump the energy gap to the vacuum level. In other words, in the surface layer 8 that does not include energy levels less than 2 eV deep, electron emission is thought to begin only when the energy of the light irradiating the surface layer 8 is increased to 2 eV or more.

On the other hand, a protective layer that has been formed as a film using CaO, SrO, and/or BaO in an atmosphere in which the partial pressure of oxygen is approximately 0.01 Pa (e.g., see patent document 4) includes multiple energy levels less than 2 eV deep due to oxygen defects. Therefore it can be considered that electron emission would begin even when the energy of the irradiation light is less than 2 eV. In other words, the energy level unique to CaO, SrO, and BaO exists in an area at a depth of 6.05 eV or less in the surface portion of the surface layer 8, and unnecessary energy levels originating from oxygen defects etc. do not exists less than 2 eV deep in the surface layer 8. This structure enables achieving both a reduction in firing voltage and the prevention of excessive charge loss. Here, the term "light" refers to a wide range of light including X-rays, ultraviolet radiation, infrared radiation, and the like.

Note that the surface layer 8 of the present embodiment only has electron levels 2 eV deep or more from the vacuum level, or does not have electron levels less than 2 eV deep from the vacuum level. However, an electron level less than 2 eV deep may exist as long as the effects of the present invention can be sufficiently achieved.

Furthermore, although the surface layer 8 of the present embodiment includes one or more of CaO, SrO, and BaO as a main component, CaO is preferable due to the relatively low amount of adsorption of impurities and the ability to obtain a highly pure crystal structure. Also, it is known that forming the surface layer 8 from a solid solution of CaO, SrO, and BaO has the effect of suppressing the adsorption of impurities in the layer, and is more preferable than a layer made from a single material for a number of reasons.

As described above, a layer formed as a film using CaO, SrO, and/or BaO in an atmosphere in which the partial pressure of oxygen is approximately 0.01 Pa (e.g., the protective layer recited in patent document 4) has a crystal structure that includes a large number of oxygen defects, and an excessive amount of electrons are emitted from an unnecessary energy level in the vicinity of the vacuum level during PDP driving. In this case, although it possible to raise the driving voltage in order to compensate for the lack of wall charge retention, the present invention eliminates the need for such compensation and aims to reduce energy consumption by achieving low-voltage driving. The present invention does not require a high-voltage driving circuit compatible with a high driving voltage, thereby being highly advantageous in terms of a reduction in manufacturing cost.

Conventionally there is technology for doping the protective layer with impurities to create an oxygen defect portion and provide an energy level at a depth of 4 eV or less from the vacuum level (see patent document 5 for details). However, the lifetime of a PDP having such a structure is shorter than the present invention. Specifically, energy levels that arise from impurities, oxygen defects, etc. and that are not unique to the main component of the protective layer are lost due to changes in the crystal structure of the protective layer over prolonged use of the PDP. In contrast, in the PDP 1, the surface layer 8 includes an energy level unique to the main component thereof, thereby having an excellent advantage of achieving a long-term stable secondary electron emission property.

MgO Particles 16

The inventors of the present invention confirmed by experimentation that the MgO particles 16 mainly have the effects of suppressing "discharge delay" in write discharges and eliminating the dependency of "discharge delay" on temperature. In the present embodiment, the MgO particles 16 are provided for emitting initial electrons during driving, using the fact that the MgO particles 16 have a higher initial electron emission property than the surface layer 8.

A main cause of "discharge delay" is thought to be an insufficient amount of initial elections, which are triggers, being emitted from the surface of the surface layer 8 into the discharge spaces 15 during firing. In view of this, the MgO particles 16 are dispersed on the surface of the surface layer 8 so as to obtain a large amount of surface area, in order to effectively contribute to the emission of electrons into the discharge spaces 15. Accordingly, an abundant amount of electrons are emitted from the MgO particles 16 during driving initialization, thereby eliminating discharge delay. Such an initial electron emission property enables even a high definition PDP 1 to be driven at high speed with good discharge response. Note that providing MgO particles 16 on the surface of the surface layer 8 mainly has the effect of suppressing "discharge delay" in mainly writing discharges, and additionally has the effect of eliminating the dependency of "discharge delay" on temperature.

In the PDP 1, the combination of the surface layer 8 that achieves the effects of both a low driving voltage and charge retention and the MgO particles 16 that achieve the effect of preventing discharge delay enables high-speed driving of a high-definition PDP at a low voltage, and can be expected to achieve high image display performance due to suppressing the occurrence of cells that fail to light.

Furthermore, the provision of the MgO particles on the surface of the surface layer 8 has the constant effect of protecting the surface layer 8. Specifically, although the surface layer 8 has a high secondary electron emission coefficient and enables low-voltage driving of PDPs, the surface layer 8 has a relatively high adsorption of impurities such as water, carbon dioxide, and hydrogen carbide. The adsorption of impurities causes a reduction in the secondary electron emission property and discharge initialization property. Therefore coating the surface layer 8 with the MgO particles 16 enables preventing the adsorption of impurities from the discharge spaces 15 to the surface of the surface layer 8 where the coating of MgO particles 16 is provided. This structure enables improving the lifetime of the PDP 1.

Embodiment 2

Figure 6:
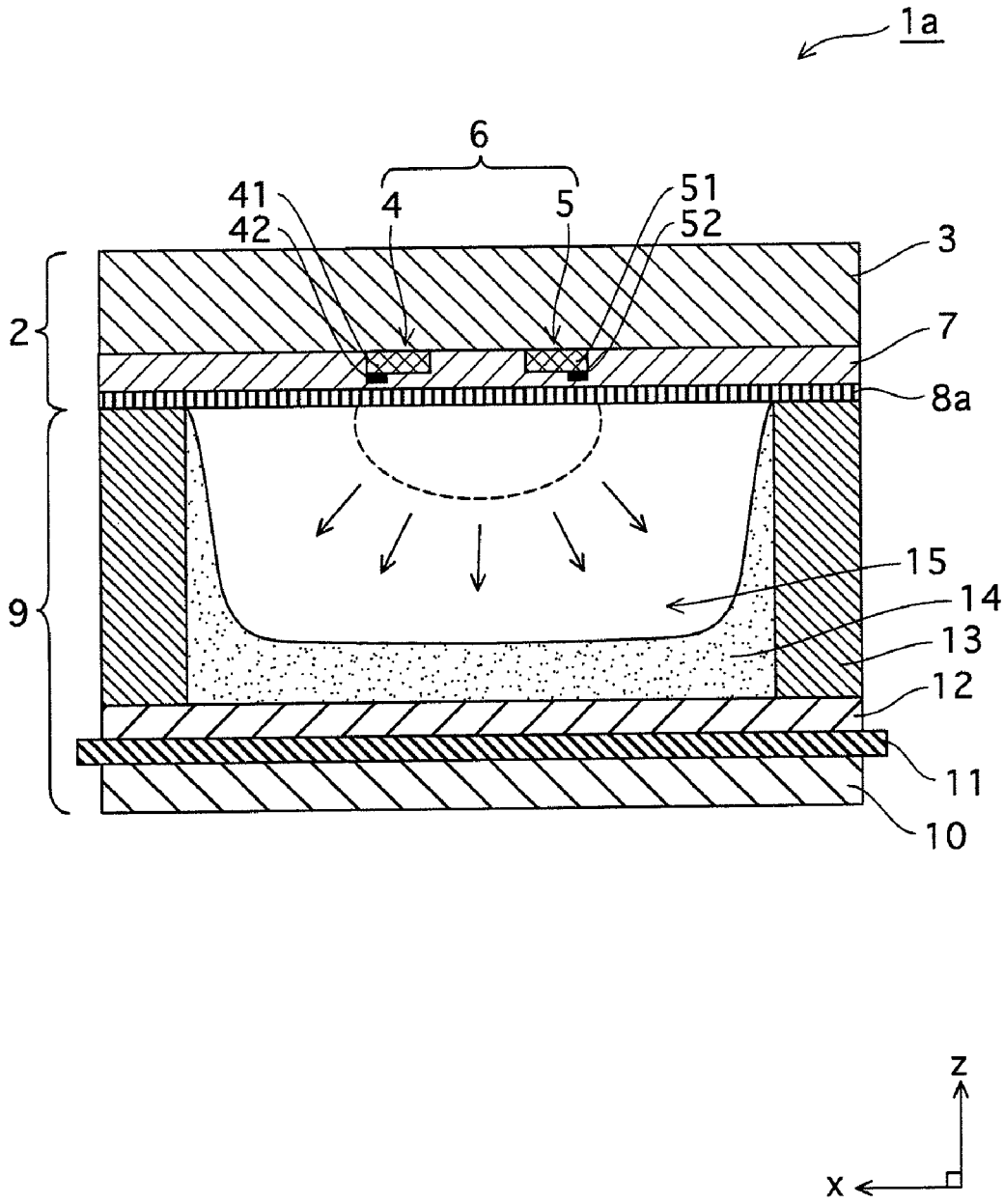
FIG. 6 is a cross-sectional view showing a structure of a PDP pertaining to embodiment 2 of the present invention.

The following describes embodiment 2 of the present invention with focus on differences from embodiment 1. FIG. 6 is a cross-sectional view showing a structure of a PDP pertaining to embodiment 2.

In embodiment 1, a protective layer is formed by dispersing MgO particles 16 on the surface layer 8. However, in cases where the panel standard is not full-HD (900 vertical lines or more) single scan driving, but rather is double scan driving such as general HD (800 vertical lines or more) or the VGA standard, there is not much need for high-speed driving in such PDPs. It can be said that in such cases, there is little need to provide the MgO particles 16 in order to prevent discharge delay when performing PDP high-speed driving.

A PDP 1*a* pertaining to embodiment 2 has a structure that is applicable in such cases. Specifically, as shown in FIG. 6, the protective layer is constituted from only a surface layer 8*a*. In other words, the surface layer 8*a* is formed as a film from one or more of BaO, CaO, and SrO in an oxygen atmosphere.

The PDP 1*a* of embodiment 2 has a favorable secondary electron emission property during driving due to the inclusion of the surface layer 8*a* that was formed as a film in an oxygen atmosphere and includes one or more of BaO, CaO, and SrO as a main component. As a result, low-voltage driving is possible in the PDP 1*a* similarly to embodiment 1. Furthermore, the surface layer 8*a* is highly pure due to being formed as a film in an atmosphere in which the partial pressure of oxygen is 0.025 Pa or more, and the occurrence of an unnecessary energy level less than 2 eV deep has been suppressed. This structure prevents excessive electron emission from such an unnecessary energy level, thereby suppressing the problem of excessive charge loss. Accordingly, embodiment 2 enables low-voltage driving as well as prevents the occurrence of cells that fail to light and has excellent image display performance.

PDP Manufacturing Method

The following describes an exemplary manufacturing method for the PDPs 1 and 1*a* of embodiments 1 and 2 respectively. The only substantial difference between the PDPs 1 and 1*a* is the provision or lack of the MgO particles 16. All other manufacturing steps are the same for the PDPs 1 and 1*a*.

Manufacture of Back Panel

The back panel glass 10 made of soda-lime glass and having a thickness of approximately 2.6 mm is provided, and a conductive material including Ag as a main component is applied on a surface of the back panel glass 10 in stripes at a constant interval with use of a screen printing method, thus forming the data electrodes 11 that are several μm thick (e.g., approximately 5 μm). The electrode material of the data electrodes 11 can be a metal such as Ag, Al, Ni, Pt, Cr, Cu, Pd, etc., a material such as a conductive ceramics including a carbide, nitride, etc. of various metals, a combination of any of the above, or a layered electrode formed from layers of any of the above.

In order for the planned PDP 1 to be a 40-inch class NTSC standard panel or a VGA standard panel, the interval between adjacent data electrodes 11 is set to 0.4 mm or less.

Then, a glass paste made of lead-based or non-lead-based low melting point glass and an $SiO_2$ material is applied to a thickness of approximately 20 to 30 μm over an entire face of the back panel glass 10 on which the data electrodes 11 have been formed. Baking is then performed, thus forming a dielectric layer 12.

Next, the ribs 13 are formed in a predetermined pattern on a face of the dielectric layer 12. The ribs 13 are formed by applying a low melting point glass material paste, and using a sandblasting method or photolithography method to form a grid pattern that divides the array of discharge cells into rows and columns, so as to form borders between adjacent discharge cells (not depicted).

After forming the ribs 13, a phosphor ink including red (R), green (G), or blue (B) phosphors that are commonly used in AC-type PDPs is applied to the wall faces of the ribs 13 and the surface of the dielectric layer 12 that is exposed between the ribs 13. The phosphor ink is dried and baked, thus forming the various phosphor layers 14.

The following are exemplary chemical compositions of RGB phosphors that are applicable in the present invention.

| | |
|---|---|
| Red phosphor | $(Y,Gd)BO_3$: Eu |
| Green phosphor | $Zn_2SiO_4$: Mn |
| Blue phosphor | $BaMgAl_{10}O_{17}$: Eu |

The phosphor material preferably has an average particle diameter of 2.0 μm. 50% by mass of the phosphor material is placed into a server, 1.0% by mass of ethylcellulose and 49% by mass of a solvent (α-terpineol) are added, and a sand mill is used to agitate the mixture, thus creating a phosphor ink having a viscosity of $15\times10^{-3}$ Pa·s. The phosphor ink is then applied between the ribs 13 by being injected through a 60-μm diameter nozzle with use of a pump. The panel is moved in the lengthwise direction of the ribs 13 so that the phosphor ink is applied in a stripe pattern. Thereafter, the panel is baked at 500° C. for 10 minutes, thus forming the phosphor layers 14.

This completes the formation of the back panel 9.

Note that although the front panel glass 3 and back panel glass 10 are made of soda-lime glass in the above-described exemplary method, this is merely one example. The front panel glass 3 and back panel glass 10 can be made of another material.

Manufacture of Front Panel 2

The display electrodes 6 are formed on a face of the front panel glass that is approximately 2.6 mm thick and made of soda-lime glass. Although the following describes an example in which the display electrodes 6 are formed by a printing method, a die coating method, a blade coating method, or the like may be used.

First, a transparent electrode material such as ITO, $SnO_2$, or ZnO is applied onto the front panel glass in a predetermined pattern (e.g., a stripe pattern) to a final thickness of approximately 100 nm, and then drying is performed. This completes the formation of the transparent electrodes 41 and 51.

Next, a photosensitive paste is prepared by mixing Ag powder, an organic vehicle, and a photosensitive resin (photodegrading resin). The photosensitive paste is applied over the transparent electrode material and covered with a mask that matches the pattern of the display electrodes 6 that are to be formed. Light exposure is performed over the mask, and after completing a developing step, baking is performed at a temperature of 590° C. to 600° C. As a result, the bus lines 42 and 52 that are ultimately several μm thick are formed on the transparent electrodes 41 and 51. Such a photomask method enables forming thin-line bus lines 42 and 52 that have a line width of approximately 30 μm, in contrast with a screen printing method in which the smallest line width is conventionally 100 μm. Instead of Ag, the metal material forming the bus lines 42 and 52 can be Pt, Au, Al, Ni, Cr, tin oxide, indium oxide, etc. Instead of the above method, the bus lines 42 and 52 can be formed by using a vapor deposition method, a sputtering method, or the like to form a film of electrode material, and by then performing etching processing.

Next, a paste is prepared by mixing lead-based or non-lead-based low melting point glass whose softening point is 550° C. to 600° C., $SiO_2$ powder, and an organic binder made of butyl carbitol acetate etc., and the paste is applied onto the display electrodes 6. Then baking is performed at 550° C. to 600° C., thus forming the dielectric layer 7 that has an ultimate film thickness of several μm to several tens of μm.

Formation of Surface Layers 8 and 8*a*

The following describes steps for forming the surface layer 8 of embodiment 1 and the surface layer 8*a* of embodiment 2.

A film is formed on the surface of the dielectric layer 7 in an oxygen atmosphere using one or more of CaO, SrO, and BaO. Alternatively, a film can be formed from a solid solution including oxides of the above materials.

A known method such as an electron beam vapor deposition method, a sputtering method, an ion plating method, or the like can be used to form the film. The atmosphere during film formation is set so that the partial pressure of oxygen is 0.025 Pa or more. Note that the actual upper limit of the oxygen partial pressure is determined according to the film formation rate. For example, the actual upper limit is 1 Pa in the case of using the sputtering method, and the actual upper limit is 0.1 Pa in the case of using an EP vapor deposition method, which is one example of a vapor deposition method.

Also, in order to prevent the adhesion of water and the adsorption of impurities during formation of the surface layer 8 (or the surface layer 8*a*), the atmosphere during film formation is hermitically sealed apart from the outside atmosphere, and is a dry atmosphere using a dry gas. The dry gas has a dew point of −20° C. or below, or more preferably −40° C. or below (for details, see patent document 4).

Preparing such an atmosphere for film formation suppresses the formation of unnecessary electron levels due to impurities and oxygen defects, and enables obtaining a surface layer 8 that only has an electron level that is 2 eV deep or more from the vacuum level.

Next, it is necessary to prepare the MgO particles 16 in the case of manufacturing the PDP 1 of embodiment 1. The MgO particles 16 should be supplied as a powder material, and can be manufactured using either of the gas-phase synthesis method and the precursor baking method described below.

Gas-Phase Synthesis Method

A magnesium metal material (99.9% pure) is heated in an atmosphere filled with an inert gas. While maintaining the heating, a small amount of oxygen is introduced to the atmosphere, and the magnesium is directly oxidized, thus creating the MgO particles 16.

Precursor Baking Method

In this method, any of the below-listed MgO precursors are baked evenly at a high temperature (e.g., 700° C. or higher) and then cooled, thereby obtaining MgO particles. The MgO precursor can be any one or more (or a mixture of two or more) selected from the group of, for example, magnesium alkoxide ($Mg(OR)_2$), magnesium acetylacetone ($Mg(acac)_2$), magnesium hydroxide ($Mg(OH)_2$), magnesium carbide, magnesium chloride ($MgCl_2$), magnesium sulfate ($MgSO_4$), magnesium nitrate ($Mg(NO_3)_2$), and magnesium oxalate ($MgC_2O_4$). Note that some of the above compounds may normally be in hydrate form. These compounds in hydrate form may also be used.

The magnesium compound selected as the MgO precursor is adjusted so that MgO obtained after baking has a purity of 99.95% or more, or more preferably 99.98% or more. This is because of the fact that if a certain amount or more of an impurity element such as an alkyl metal, B, Si, Fe, or Al is included in the magnesium compound, unnecessary adhesion and sintering occurs during heat processing, thereby making it difficult to obtain highly crystalline MgO particles. For this reason, the precursor is adjusted in advanced by eliminating impurity elements.

The MgO particles 16 obtained by any of the above methods are dispersed in a solvent. The dispersion liquid is then dispersed on the surface of the surface layer 8 using a spray method, a screen printing method, or an electrostatic application method (MgO particle provision step). Thereafter drying and baking are performed to eliminate the solvent, and the MgO particles 16 are thus attached to the surface of the surface layer 8.

Completion of PDP

The manufactured front panel 2 and back panel 9 are disposed in opposition and sealed together with the use of sealing glass. Thereafter, the discharge space 15 is evacuated to a high vacuum ($1.0\times10^{-4}$ Pa), and an Ne—Xe based, He—Ne—Xe based, Ne—Xe—Ar based discharge gas or the like is enclosed in the discharge space 15 at a predetermined pressure (here, 66.5 kPa to 101 kPa).

The PDPs 1 and 1*a* are completed upon performing the above-described steps.

Performance Evaluation Test

Experiment 1

Figure 7:
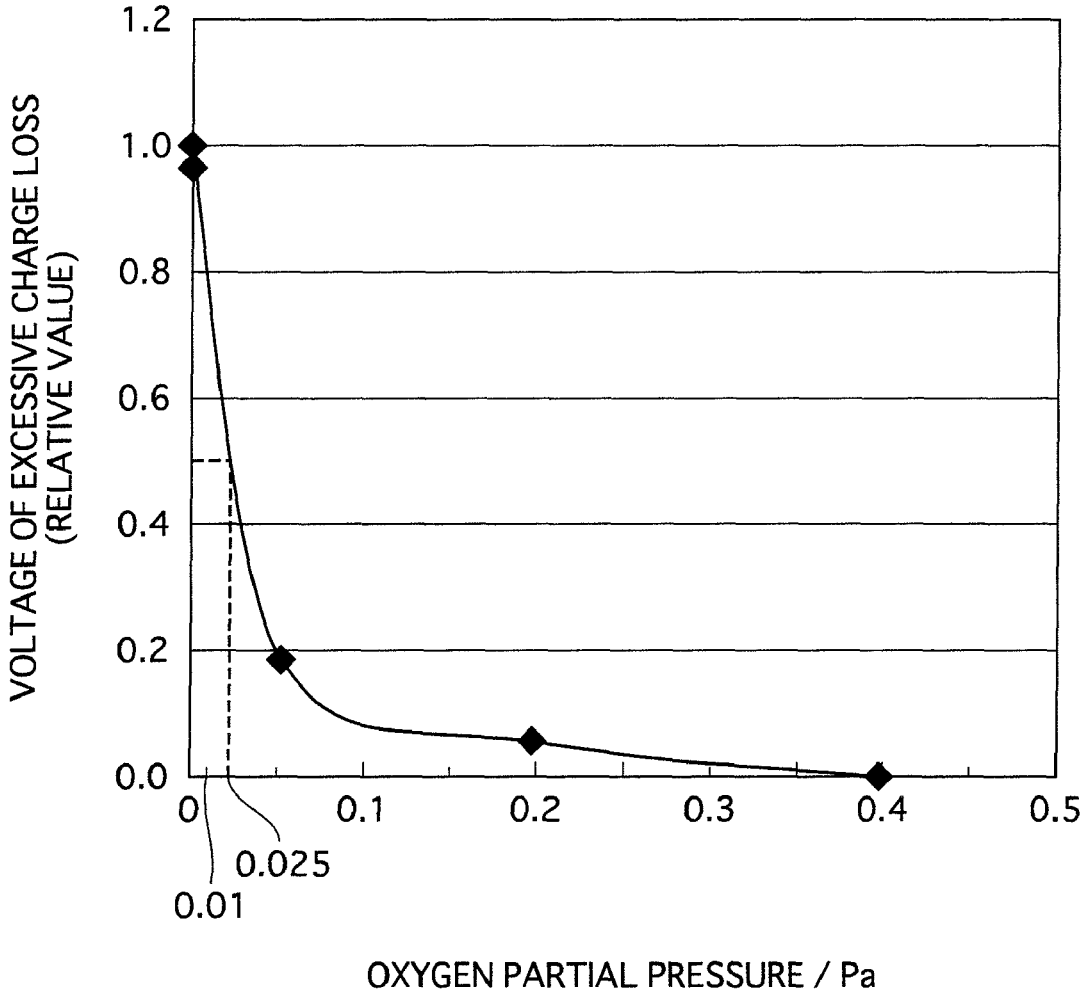
FIG. 7 is a graph showing a relationship between oxygen partial pressure during film formation and charge-loss voltage.

A protective layer made of BaO (corresponding to the surface layer 8*a* of embodiment 2) was formed using a sputtering method, and the relationship between the voltage of excessive charge loss and the oxygen partial pressure in the film formation atmosphere was examined. FIG. 7 shows results of this examination (the relationship between the voltage of excessive charge loss and the oxygen partial pressure during film formation). The voltage value of excessive charge loss when oxygen has not been added to the film formation atmosphere is set to 1, and other values are plotted relative thereto.

As shown in FIG. 7, the experiment results confirmed that as the oxygen partial pressure in the film formation atmosphere increases, the voltage value of excessive charge loss decreases. This is thought to be because the formation of shallow electron levels originating from oxygen defects is suppressed in the forbidden band of the protective layer since oxygen has been added to the film formation atmosphere, thereby suppressing the excessive emission of electrons from the protective layer and obtaining a constant charge retention property.

However, when the relative voltage value of excessive charge loss is 0.5 or greater, unlit cells begin to appear when using a required set voltage for driving.

The above results of the experiment show that a favorable oxygen partial pressure in the film formation atmosphere is 0.025 Pa or more. Note that other experiments performed by the inventors of the present invention showed that substantially the same results as in FIG. 7 are obtained when using a film formed by an EB vapor deposition method or ion plating method. Also, substantially the same results as in FIG. 7 are obtained when using CaO or SrO as the material of the protective layer.

Conventionally there is technology for forming a protective layer using CaO, SrO, or BaO in an atmosphere in which the partial pressure of oxygen is approximately 0.01 Pa (e.g., see patent document 4). However, the content of FIG. 7 shows that the surface layer of the present invention cannot be obtained when using such an oxygen partial pressure value. In other words, when the oxygen partial pressure in the film formation atmosphere is approximately 0.01 Pa, the voltage value of excessive charge loss approaches 1.0, which is almost no different from the voltage value when oxygen has not been added to the film formation atmosphere.

Accordingly, as described above, the oxygen partial pressure should be at least 0.025 Pa in order to effectively prevent excessive charge loss in PDPs.

Furthermore, an oxygen partial pressure of 0.2 Pa or more enables obtaining an even more remarkable effect of preventing excessive charge loss.

Experiment 2

Next, the following PDP samples 1 to 11 were prepared. Here, samples 7 and 8 (working examples 1 and 2) correspond to the structure of embodiment 2, and samples 10 and 11 (working examples 4 and 5) correspond to the structure of embodiment 1.

Sample 1 (comparative ex. 1): conventional structure for most basic PDP, including a surface layer made of MgO.

Sample 2 (comparative ex. 2): surface layer made of MgO doped with Al.

Sample 3 (comparative ex. 3): surface layer made of MgO, on which MgO particles obtained by baking an MgO precursor have been dispersed using a printing method.

Sample 4 (comparative ex. 4): surface layer made of MgO doped with Al, on which MgO particles obtained by baking an MgO precursor have been dispersed using a printing method.

Sample 5 (comparative ex. 5): surface layer made of BaO and formed in a case where the oxygen partial pressure is 0 Pa (no oxygen).

Sample 6 (comparative ex. 6): surface layer made of Bao and formed in a case where the oxygen partial pressure is 0 Pa (no oxygen), on which MgO particles created by a gas-phase synthesis method have been dispersed using a spray method.

Sample 7 (working ex. 1): surface layer made of BaO formed in a case where the oxygen partial pressure is 0.2 Pa.

Sample 8 (working ex. 2): surface layer made of SrO formed in a case where the oxygen partial pressure is 0.05 Pa.

Sample 9 (working ex. 3): surface layer made of CaO formed in a case where the oxygen partial pressure is 0.05 Pa.

Sample 10 (working ex. 4): surface layer made of BaO and formed in a case where the oxygen partial pressure is 0.2 Pa, on which MgO particles created by a gas-phase synthesis method have been dispersed using a spray method.

Sample 11 (working ex. 5): surface layer made of CaO and formed in a case where the oxygen partial pressure is 0.05 Pa, on which MgO particles obtained by baking an MgO precursor have been dispersed using a spray method.

Measurement of Firing Voltage

For each of the PDP samples 1 to 11, the firing voltage was measured in cases where the discharge gas was a 100% pure Xe gas and an Xe—Ne gas mixture in which the Xe partial pressure was 15%.

Measurement of Discharge Delay and Excessive Charge Loss

Discharge delay in a write discharge and excessive charge loss were evaluated in case of using the Ne—Xe gas mixture in which the Xe partial pressure is 15%. The evaluation method involved applying a pulse corresponding to an initialization pulse in the exemplary drive waveform shown in FIG. 3 to an arbitrary discharge cell in each of the PDP samples 1 to 11, and thereafter measuring a statistical delay in discharge when applying a data pulse and scan pulse.

Also, the voltage of the excessive charge loss was measured by measuring the amount of voltage that needed to be applied to retain the wall charge after the application of the pulse corresponding to the initialization pulse.

The panel temperature was set to 25° C. for both of the measurements.

Table 1 shows the results of the experiments performed under the above-described conditions.

γ film formed in a predetermined oxygenated atmosphere fulfills the role of enabling low-voltage driving and charge retention, and the MgO particles fulfill the role of emitting a necessary amount of initial electrons for a write discharge (ensuring an initial electron emission property. In other words, the films synergistically exhibit their separate properties.

Note that properties similar to the samples 10 and 11 (working examples 4 and 5) can be obtained even when the protective layer is made of SrO and formed in an atmosphere in which the partial pressure of oxygen is 0.025 Pa or more, and MgO particles created by a gas-phase synthesis method or baking a precursor have been dispersed on the protective layer by a spray method.

As described in embodiment 2, when there is not much demand for a property related to discharge delay time, samples 7 to 9 (working examples 1 to 3) achieve both excellent effects of reducing the firing voltage and reducing the voltage of excessive charge loss, and can be said to be clearly superior to the comparative examples. When 100% Xe is used as the discharge gas, the firing voltage of the samples 7 to 9 (working examples 1 to 3) is 350 V or less, and a favorable effect of reducing the voltage of excessive charge loss is

TABLE 1

| | 1st Layer (material/oxygen partial pressure) | 2nd Layer | Number of layers | Firing Voltage 15% Xe | Firing Voltage 100% Xe | Discharge Delay **1 | Voltage of Excessive Charge Loss **2 |
|---|---|---|---|---|---|---|---|
| Sample 1 (comparative ex. 1) | MgO/0 Pa | none | 1 | 274 V | 440 V | 1.00 (X) | 0 V (O) |
| Sample 2 (comparative ex. 2) | Al-doped MgO/0 Pa | none | 1 | 281 v | 432 V | 0.33 (O) | 36 V (X) |
| Sample 3 (comparative ex. 3) | MgO/0 Pa | baked-precursor crystal | 2 | 278 V | 424 V | 0.05 (O) | 10 V (O) |
| Sample 4 (comparative ex. 4) | Al-doped MgO/0 Pa | baked-precursor crystal | 2 | 272 V | 420 V | 0.07 (O) | 44 V (X) |
| Sample 5 (comparative ex. 5) | BaO/0 Pa | none | 1 | 194 V | 240 V | 0.26 (O) | 51 V (X) * |
| Sample 6 (comparative ex. 6) | BaO/0 Pa | gas-phase synthesized crystal | 2 | 188 V | 239 V | 0.33 (O) | 56 V (X) * |
| Sample 7 (working ex. 1) | BaO/0.2 Pa | none | 1 | 168 V | 214 V | 2.44 (X) | 3 V (O) * |
| Sample 8 (working ex. 2) | SrO/0.05 Pa | none | 1 | 185 V | 268 V | 4.17 (X) | 0 V (O) * |
| Sample 9 (working ex. 3) | CaO/0.05 Pa | none | 1 | 207 V | 312 V | 4.35 (X) | 0 V (O) * |
| Sample 10 (working ex. 4) | BaO/0.2 Pa | gas-phase synthesized crystal | 2 | 186 V | 243 V | 0.36 (O) | 4 V (O) * |
| Sample 11 (working ex. 5) | CaO/0.05 Pa | baked-precursor crystal | 2 | 214 V | 322 V | 0.07 (O) | 12 V (O) * |

* Extrapolated value

**1 Relative rate based on the discharge delay of sample 1 at 25° C. being 1. "O" indicates the absence of and "X" indicates the presence of unlit cells due to discharge delay.

**2 Relative value based on the voltage of excessive charge loss of sample 1 being 0 V. "O" indicates the absence of and "X" indicates the presence of unlit cells due to excessive charge loss when using the set voltage for the panel.

Experiment Results

The results in table 1 show that unlike samples 1 to 6 (comparative examples 1 to 6), samples 10 and 11 (working examples 4 and 5) that correspond to the structure of embodiment 1 have a good balance in the effects of reducing the firing voltage, reducing the discharge delay time, and reducing excessive discharge loss, and therefore the protective layers therein have superior performance. The samples 10 and 11 (working examples 4 and 5) are not only favorable in terms of reducing the voltage of excessive charge loss and reducing the firing voltage to 350 V or less in a case of using 100% Xe as the discharge gas, but also effectively suppress discharge delay.

The reasons for the high degree of balance in effects in these cases is thought to be that the surface layer that is a high achieved. Therefore, regarding these two points, the samples 7 to 9 have superior properties that are equivalent to the samples 10 and 11.

Note that in another experiment, the inventors of the present invention confirmed that in the case of high γ films such as in the samples 5 and 7 to 9 (comparative example 5 and working examples 1 to 3), the firing voltage rose over the passage of discharge time and installation time, whereas a rise in firing time was suppressed in the PDP samples 6, 10, and 11 (comparative example 6 and working examples 4 and 5).

Also, since the firing voltage in samples 1 to 4 (comparative examples 1 to 4) is 400 V or more when using 100% Xe as the discharge gas, low-voltage driving cannot be achieved. Also, although the firing voltage in samples 5 and 6 (comparative examples 5 and 6) is 240 V or less, which is favorable, when using 100% Xe as the discharge gas, a charge retention effect cannot be achieved, and a sufficient reduction in the voltage of excessive charge loss cannot be obtained. Accordingly, the above PDP samples are not suitable for low-voltage driving.

The above-described experiment results confirm the superiority of the present invention.

INDUSTRIAL APPLICABILITY

A PDP of the present invention is applicable to television apparatuses, computer display apparatuses, etc. in transportation organizations, public facilities, households, etc., in particular as a gas discharge panel technology that enables low-voltage driving in high definition image display.

The invention claimed is:

1. A plasma display panel having a first substrate and a second substrate that oppose each other with a discharge space therebetween and are sealed together, a display electrode being provided on the first substrate, and the discharge space being filled with a discharge gas, wherein a surface layer has been provided on the first substrate and is directly exposed to the discharge space to provide a charge retention property, a main component of the surface layer being one or more oxide selected from the group consisting of calcium oxide, barium oxide, and strontium oxide, and the surface layer has been formed in an oxygen atmosphere in which an oxygen partial pressure is 0.025 Pa or more.

2. A plasma display panel having a first substrate and a second substrate that oppose each other with a discharge space therebetween and are sealed together, a display electrode being provided on the first substrate, and the discharge space being filled with a discharge gas, wherein a surface layer has been provided on the first substrate and is directly exposed to the discharge space to provide a charge retention property, a main component of the surface layer is one or more oxide selected from the group consisting of calcium oxide, barium oxide, and strontium oxide, and in the surface layer, an electron level exists only at a depth of 2 eV or more from a vacuum level.

3. A plasma display panel having a first substrate and a second substrate that oppose each other with a discharge space therebetween and are sealed together, a display electrode being provided on the first substrate, and the discharge space being filled with a discharge gas, wherein a surface layer has been provided on the first substrate and is directly exposed to the discharge space to provide a charge retention property, a main component of the surface layer is one or more oxide selected from the group consisting of calcium oxide, barium oxide, and strontium oxide, and in the surface layer, an electron level at a depth of less than 2 eV from a vacuum level has been eliminated.

4. The plasma display panel of claim 1, wherein magnesium oxide particles have been provided on a surface of the surface layer that faces the discharge space.

5. The plasma display panel of claim 2, wherein magnesium oxide particles have been provided on a surface of the surface layer that faces the discharge space.

6. The plasma display panel of claim 3, wherein magnesium oxide particles have been provided on a surface of the surface layer that faces the discharge space.

7. The plasma display panel of claim 4, wherein the magnesium oxide particles have been formed by a gas-phase oxidation method.

8. The plasma display panel of claim 4, wherein the magnesium oxide particles have been formed by baking a magnesium oxide precursor at a temperature of 700 degrees or more.

9. The plasma display panel of claim 1, wherein the surface layer is a solid solution including one or more oxide selected from the group consisting of calcium oxide, barium oxide, and strontium oxide.

10. The plasma display panel of claim 2, wherein the surface layer has been formed in an oxygen atmosphere in which an oxygen partial pressure is 0.025 Pa or more.

11. The plasma display panel of claim 3, wherein the surface layer has been formed in an oxygen atmosphere in which an oxygen partial pressure is 0.025 Pa or more.

12. A manufacturing method for a plasma display panel, comprising the steps of:

forming a surface layer on a first substrate on which a display electrode is provided, a main component of the surface layer being one or more oxide selected from the group consisting of calcium oxide, barium oxide, and strontium oxide, and the surface layer being formed in an oxygen atmosphere in which an oxygen partial pressure is 0.025 Pa or more; and sealing together the first substrate and a second substrate that have been arranged with a discharge space therebetween so that the surface layer is directly exposed to the discharge space to provide a charge retention property.

13. The manufacturing method of claim 12, further comprising the step of:

providing magnesium oxide particles on the surface layer between the surface layer forming step and sealing step.

14. The manufacturing method of claim 13, wherein the magnesium oxide particles used in the providing step have been formed by a gas-phase oxidation method.

15. The manufacturing method of claim 13, wherein the magnesium oxide particles used in the providing step have been formed by baking a magnesium oxide precursor at a temperature of 700 degrees or more.

16. The manufacturing method of claim 12, wherein in the surface layer forming step, the surface layer is formed by one or more of a vapor deposition method, a sputtering method, and an ion-plating method.

17. The manufacturing method of claim 12, wherein in the surface layer forming step, the surface layer is formed as a solid solution including one or more oxide selected from the group consisting of calcium oxide, barium oxide, and strontium oxide.

* * * * *